US009379475B2

(12) United States Patent
Endo et al.

(10) Patent No.: US 9,379,475 B2
(45) Date of Patent: Jun. 28, 2016

(54) ELECTRIC CONNECTOR

(71) Applicant: DAI-ICHI SEIKO CO., LTD., Kyoto (JP)

(72) Inventors: Takayoshi Endo, Shizuoka (JP); Sakai Yagi, Shizuoka (JP); Shuji Touno, Shizuoka (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 184 days.

(21) Appl. No.: 14/283,401

(22) Filed: May 21, 2014

(65) Prior Publication Data

US 2014/0357130 A1 Dec. 4, 2014

(30) Foreign Application Priority Data

Jun. 3, 2013 (JP) ..... 2013-117054

(51) Int. Cl.
*H01R 13/436* (2006.01)
*H01R 13/516* (2006.01)

(52) U.S. Cl.
CPC ..... *H01R 13/516* (2013.01); *H01R 13/4361* (2013.01)

(58) Field of Classification Search
CPC ..... H01R 13/436; H01R 13/4361; H01R 13/4362; H01R 13/4368; H01R 13/514
USPC ..... 439/752, 595
See application file for complete search history.

(56) References Cited

U.S. PATENT DOCUMENTS 4,705,337 A * 11/1987 Maeda ..... H01R 13/4223 439/595
7,281,961 B1 * 10/2007 Sugiyama ..... H01R 13/113 439/595
7,347,745 B1 3/2008 Raudenbush et al.
2002/0123260 A1 * 9/2002 Ichio ..... H01R 13/4361 439/352
2014/0169871 A1 * 6/2014 Nishiyama ..... H01R 13/4362 403/374.1
2014/0357130 A1 * 12/2014 Endo ..... H01R 13/4361 439/626
2014/0364005 A1 * 12/2014 Yagi ..... H01R 43/22 439/595

FOREIGN PATENT DOCUMENTS

EP 0 903 814 3/1999
FR 2 358 034 2/1978

(Continued)

OTHER PUBLICATIONS

Extended European search report issued Oct. 1, 2014 in corresponding to patent application No. 14166391.4.

*Primary Examiner* — Abdullah Riyami
*Assistant Examiner* — Nader J Alhawamdeh
(74) *Attorney, Agent, or Firm* — Wenderoth, Lind & Ponack, L.L.P.

(57) ABSTRACT

The electric connector includes a plurality of terminals each having a stepped portion recessed or raised in a direction intersecting a direction in which the terminals are inserted into a later-mentioned housing, a housing formed with an opening, the terminals being inserted into the housing, and a holder inserted into the housing through the opening and engaged to the stepped portions of the terminals to thereby fix the terminals in the housing, the holder including a front and a pair of sidewalls all of which are shaped to be engageable to the stepped portions of the terminals when the holder is inserted into the housing, and a pair of flexible portions resiliently deformable to move towards and away from each other.

20 Claims, 22 Drawing Sheets

(56) References Cited

FOREIGN PATENT DOCUMENTS

| | | |
|---|---|---|
| FR | 2 853 770 | 10/2004 |
| GB | 1 526 616 | 9/1978 |
| JP | 7-320809 | 12/1995 |
| JP | 10-50381 | 2/1998 |
| JP | 2010-517221 | 5/2010 |
| WO | 2008/091487 | 7/2008 |

* cited by examiner

ELECTRIC CONNECTOR

BACKGROUND OF THE INVENTION

1. Field of the Invention

The invention relates to an electric connector used for electrically connecting wires through which electric signals are transmitted to each other, and further to a holder used in the electric connector.

2. Description of the Related Art

There have been suggested a lot of electric connectors each including a housing in which a plurality of terminals are housed, and a holder inserted into the housing for fixing the terminals in the housing.

FIG. 24 is a cross-sectional view of a plug 500 suggested in Japanese Patent Application Publication No. H7(1995)-320809, and FIG. 25 is a rear view of the plug 500.

The plug 500 includes a pin holder 510, and a shield metal case (not illustrated) covering the pin holder 510 therewith.

The pin holder 510 includes a front portion 511 and a rear portion 512, and is formed with a plurality of through-holes 513 into each of which a pin 520 having a resilient plate 521 is inserted. A protrusion 514 formed in each of the through-holes 513 holds each of the pins 520 at a rear end of the resilient plate 521. The pin holder 510 is formed with holes each communicating to each of the through-holes 513. A lock piece 530 is inserted into each of the holes for keeping the pins 520 engaged within the pin holder 510.

FIG. 26 is a perspective view of a connector 600 suggested in Japanese Patent Application Publication No. H10(1998)-50381, FIG. 27 is longitudinal cross-sectional view of the connector 600, and FIG. 28 is a lateral cross-sectional view of the connector 600.

The connector 600 includes a housing 610 and a retainer 620. The housing 610 has a groove 611 (see FIG. 28), and the retainer 620 has a protrusion 621 extending from a lower plate 622. By inserting the protrusion 621 into the groove 611, the lower plate 622 is prevented from deforming in a direction away from a lower surface of the housing 610, ensuring that the retainer 620 is not engaged to the housing 610 when a female terminal 630 is half inserted into the housing 610.

As mentioned above, in the plug 500, a plurality of the pins 520 are kept engaged in the pin holder 510 by inserting the lock piece 530 into the pin holder 510, and, in the connector 600, a plurality of the female terminals 630 are kept engaged in the housing 610 by inserting the retainer 620 into the housing 610. However, the plug 500 and the connector 600 are accompanied with a problem that the lock piece 530 and the retainer 620 cannot be readily inserted into the pin holder 510 and the housing 610, respectively, resulting in poor operability.

Furthermore, since the pins 520 and the female terminals 630 are inserted into the pin holder 510 and the housing 610 such that they are directed in a common direction, the lock piece 530 and the retainer 620 are required to be engaged to engagement sections of the pins 520 and the female terminals 630 situated at a common location. This results in that the lock piece 530 and the retainer 620 cannot be avoided from being complicated in a shape, and further, brings complexity accompanied when the lock piece 530 and the retainer 620 are inserted into the pin holder 510 and the housing 610, respectively.

SUMMARY OF THE INVENTION

In view of the above-mentioned problems found in the conventional connectors, it is an object of the present invention to provide an electric connector making it possible to readily insert a holder into a housing, and having a simplified configuration.

In one aspect of the present invention, there is provided an electric connector including a plurality of terminals each having a stepped portion recessed or raised in a direction intersecting a direction in which the terminals are inserted into a later-mentioned housing, a housing formed with an opening, the terminals being inserted into the housing, and a holder inserted into the housing through the opening and engaged to the stepped portions of the terminals to thereby fix the terminals in the housing, the holder including a front and a pair of sidewalls all of which are shaped to be engageable to the stepped portions of the terminals when the holder is inserted into the housing, and a pair of flexible portions resiliently deformable to move towards and away from each other.

Herein, a front of the holder indicates a portion situated at a head in a direction in which the holder is inserted into the housing, and a pair of sidewalls of the holder indicates portions making contact with the housing when the holder is being inserted into the housing.

Since what is required to the holder is to include the front and the sidewalls each having a shape fittable to the stepped portions of the terminals, the holder can be designed to be simplified in a shape, and can be readily inserted into the housing. Furthermore, the holder includes the flexible portions resiliently deformable to move towards and away from each other, the holder is able to absorb a compressive force exerted thereon by the housing and/or the terminals through the resilient deformation of the flexible portions while the holder is inserted into the housing through the opening of the housing. Thus, the holder can be inserted into the housing with less force, ensuring that the electric connector can be assembled with reduced work volume.

Furthermore, the flexible portions of the holder having been inserted into the housing push the housing and/or the stepped portions of the terminals by virtue of resilient reaction forces thereof, ensuring that the holder can be stably engaged to the housing.

In addition, since the front and the sidewalls of the holder are shaped to be engageable the stepped portions of the terminals when the holder is inserted into the housing, it is possible to gather a plurality of the terminals in an area in which the stepped portions of the terminals are engaged to the front and the sidewalls of the holder, ensuring that an area for arranging the terminals therein can be avoided from being large, and thus, the electric connector can be down-sized and can save a space for itself.

It is preferable that the flexible portions and the sidewalls are formed integral with each other within a common plane.

It is preferable that the electric connector includes M terminals (M is an odd integer equal to or greater than 3), (M−1) terminals are situated in two rows such that stepped portions thereof face each other, and the remainder terminal is situated on a center line between the two rows and away from the two rows such that a stepped portion thereof is directed in a perpendicular direction in which the stepped portions of the (M−1) terminals are directed, or the remainder terminal is situated on an extension of one of the two rows such that a stepped portion thereof is directed in a direction in which the stepped portions of the (M−1) terminals are directed.

An electric connector including an odd number of terminals (for instance, three or five terminals) is actually used broadly in various industrial fields such as an automobile industry and an electric device industry. Accordingly, the present invention makes it possible to design such an electric connector to be down-sized, and to be readily assembled.

It is preferable that the electric connector includes an even number of terminals, and the terminals being situated in two rows such that stepped portions thereof face each other.

It is preferable that the holder is formed with a hole extending in a direction in parallel with a direction in which the terminals are inserted into the housing, and sidewalls of the holder defining the hole define the flexible portions.

By so designing the holder, it is possible to avoid the holder from being complicated in a shape, and to form the flexible portions capable of being preferably resiliently deformable. Furthermore, it is possible to reduce a volume of a material of which the holder is composed, and to reduce a weight of the holder by forming the above-mentioned hole through the holder.

It is preferable that the holder is formed with a recess to avoid interfering with a core wire fixed to each of the terminals.

Since there is formed a clearance between the holder inserted into the housing and a core wire fixed to each of the terminals, it is possible to avoid the core wire from being damaged due to interference between the core wire and the holder.

It is preferable that each of the flexible portions includes a protrusion fittable into a recess formed in the housing.

Since the protrusion is fit into the recess of the housing when the holder is inserted into the housing, the holder is kept engaged to the housing, and hence, the holder can be prevented from being released from the housing.

For instance, the holder may be composed of resilient and electrically insulative synthetic resin.

In another aspect of the present invention, there is provided an electric connector into which a plurality of terminals each having a stepped portion recessed or raised in a direction intersecting a direction in which the terminals are inserted into a later-mentioned housing is inserted, the electric connector including a housing formed with an opening, and a holder inserted into the housing through the opening and engaged to the stepped portions of the terminals to thereby fix the terminals in the housing, the holder including a front and a pair of sidewalls all of which are shaped to be engageable to the stepped portions of the terminals when the holder is inserted into the housing, and a pair of flexible portions resiliently deformable to move towards and away from each other.

In still another aspect of the present invention, there is provided a holder to be used in an electric connector into which a plurality of terminals each having a stepped portion recessed or raised in a direction intersecting a direction in which the terminals are inserted into a later-mentioned housing is inserted, the electric connector including a housing formed with an opening, the holder being inserted into the housing through the opening and engaged to the stepped portions of the terminals to thereby fix the terminals in the housing, the holder including a front and a pair of sidewalls all of which are shaped to be engageable to the stepped portions of the terminals when the holder is inserted into the housing, and a pair of flexible portions resiliently deformable to move towards and away from each other.

The advantages obtained by the aforementioned present invention will be described hereinbelow.

The present invention provides an electric connector making it possible to readily insert a holder into a housing, and having a simplified configuration.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Figure 1:
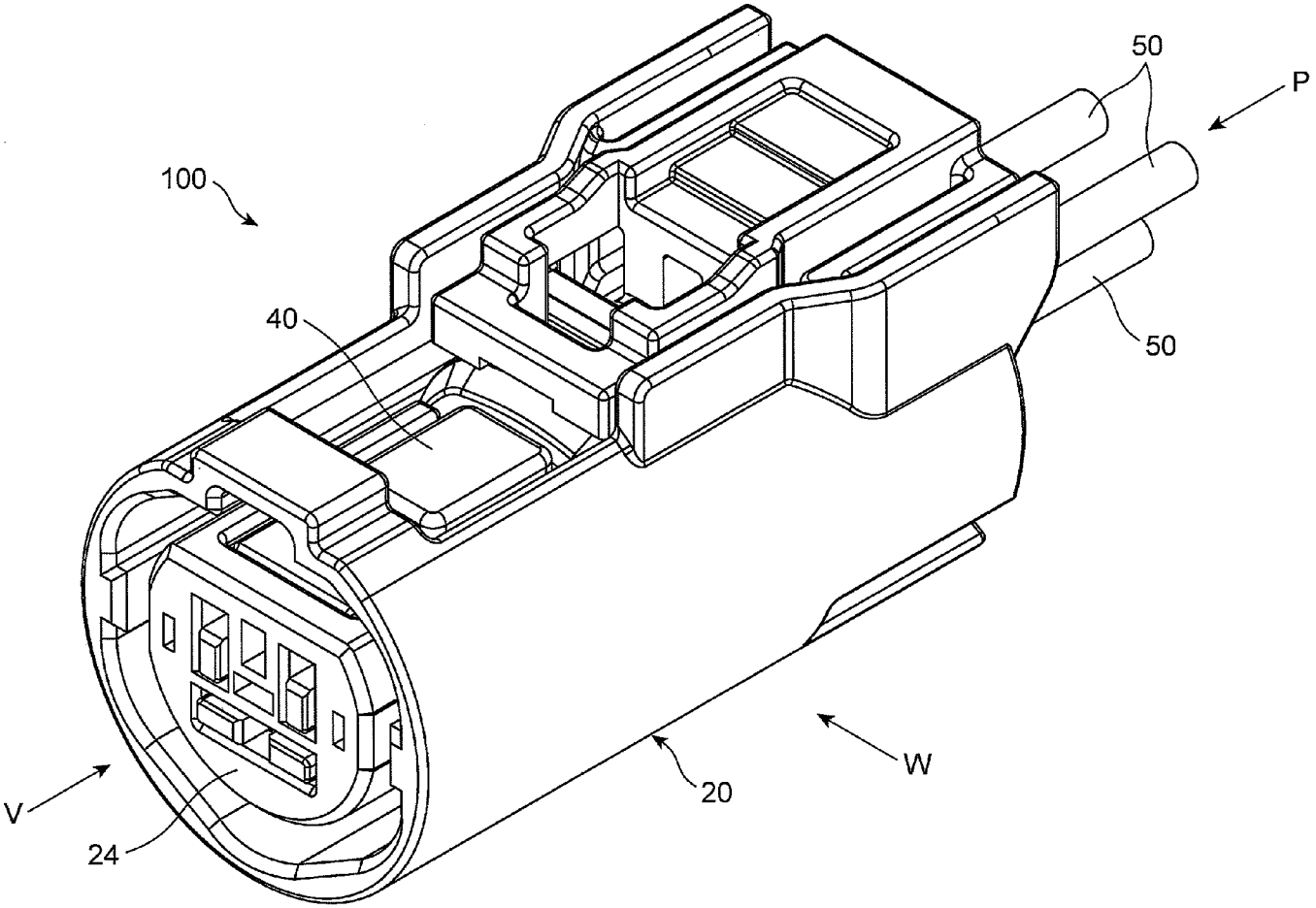
FIG. 1 is a front perspective view of the electric connector in accordance with the first embodiment of the present invention.

Preferred embodiments in accordance with the present invention will be explained hereinbelow with reference to drawings.

First Embodiment

As illustrated in FIGS. 1 to 5, 8 and 9, an electric connector 100 in accordance with the first embodiment includes three terminals 10, an electrically insulative housing 20 into which the terminals 10 are inserted in parallel to one another, and a holder 40.

Each of the terminals 10 has a stepped portion 11 recessed (or raised) in a direction intersecting a direction P in which the terminals 10 are inserted into the housing 20. The housing 20 is formed at an outer surface thereof with an opening 21 through which the holder 40 is inserted into the housing 20. The holder 40 inserted into the housing 20 is engaged to the stepped portions 11 of the terminals 10 to thereby keep the terminals 11 engaged in the housing 20.

The holder 40 includes a front 41 and a pair of sidewalls 46*a* and 46*b* all of which are shaped to be engageable to the stepped portions 11 of the terminals 10 when the holder 40 is inserted into the housing 20.

Figure 2:
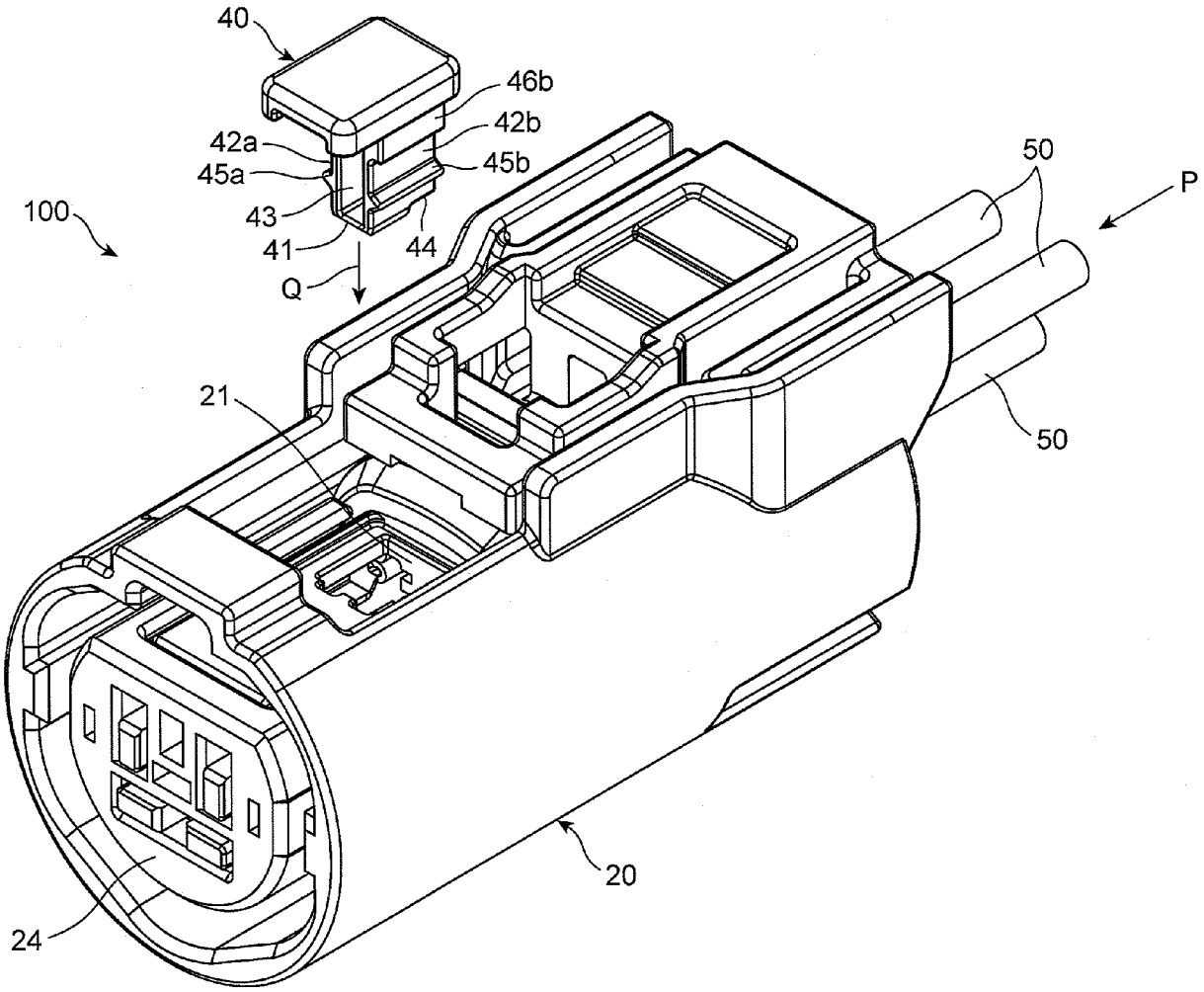
FIG. 2 is a front perspective view of the electric connector illustrated in FIG. 1 with the holder being taken out of the housing.
Figure 3:
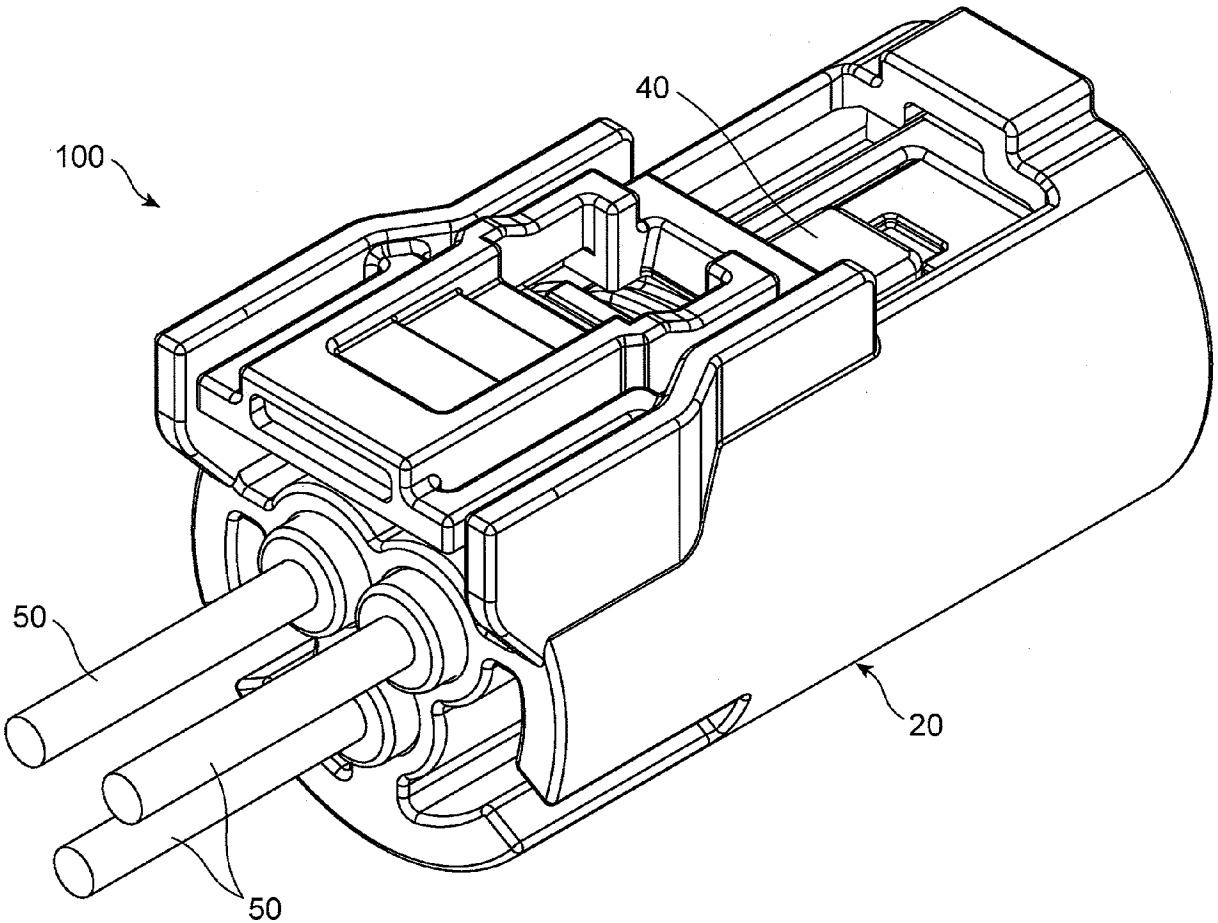
FIG. 3 is a rear perspective view of the electric connector illustrated in FIG. 1.
Figure 4:
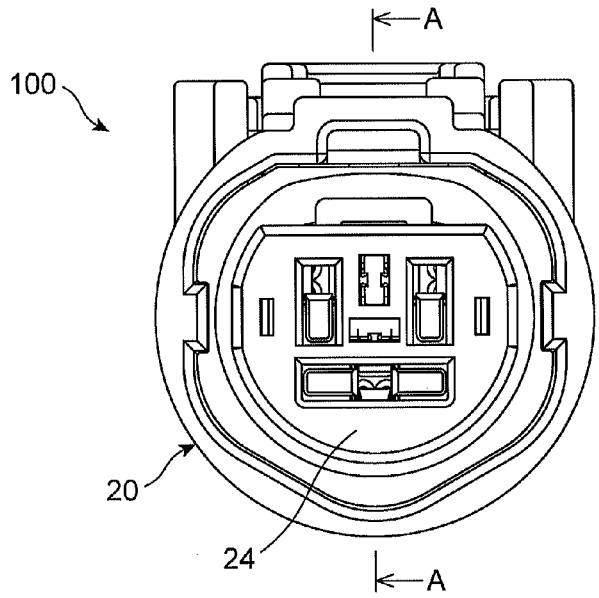
FIG. 4 is a front view of the electric connector viewed in a direction indicated with an arrow V shown in FIG. 1.
Figure 5:
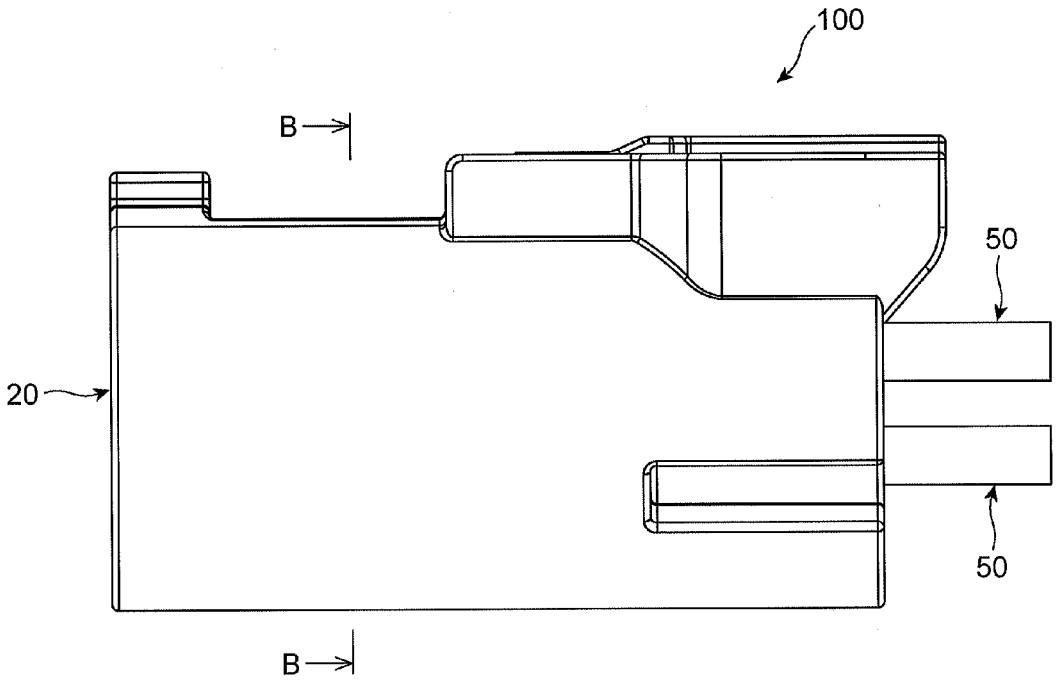
FIG. 5 is a side view of the electric connector viewed in a direction indicated with an arrow W shown in FIG. 1, with some parts being omitted.

Herein, the front 41 of the holder 40 indicates a portion situated at a head in a direction, in which the holder 40 is inserted into the housing 20 in a direction indicated with an arrow Q shown in FIG. 2 and a pair of the sidewalls 46*a* and 46*b* of the holder 40 indicates portions making contact with the housing 20 when the holder 40 is being inserted into the housing 20.

As illustrated in FIGS. 6 to 9, each of the terminals 10 includes a sheath section 12 having a square cross-section and formed at a front in the direction P in which the terminal 10 is inserted into the housing 20, and a wire compression section 13 formed at a rear in the direction P. Each of the terminals 10 includes the stepped portion 11 at a proximal end of the sheath section 12. A core wire 52 (see FIG. 6) exposed out of a cover 51 of a cable 50 is fixed in the wire compression section 13 in a compressed condition to thereby electrically connect the cable 50 and the terminal 10 to each other. Each of the terminals 10 is formed with an engagement recess 14 in the sheath section 12 such that the engagement recess 14 and the stepped portion 11 are directed in a common direction.

It should be noted that each of the terminals 10 may be designed to include a raised portion protruding in the direction P, in place of the recessed stepped portion 11.

Figure 6:
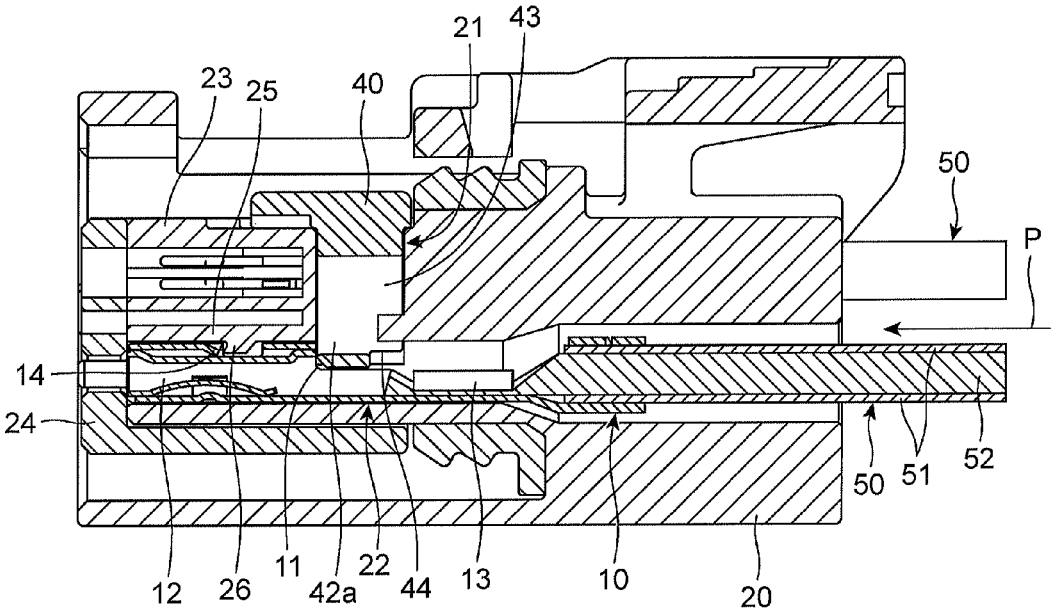
FIG. 6 is a cross-sectional view taken along the line A-A in FIG. 4, with some parts being omitted.

As illustrated in FIG. 6, the housing 20 includes therein a terminal house 23 formed with three holes 22 extending in the direction P. Each of the three terminals 10 is inserted into each of the three holes 22. The terminal house 23 is covered at a front thereof with a front holder 24. An engagement protrusion 26 protrudes towards an axis (not illustrated) of each of the holes 22 from a lance 25 partially defining a circumferential wall of the hole 22. Inserting each of the terminals 10 into each of the holes 22, the engagement protrusion 26 fits into the engagement recess 14 of the sheath section 12, thereby each of the terminals 10 being engaged in the housing 20.

As illustrated in FIGS. 2, 7, 8 and 10, a pair of flexible portions 42*a* and 42*b* extend from the sidewalls 46*a* and 46*b* of the holder 40, respectively. The flexible portions 42*a* and 42*b* are resiliently deformable in such directions that they move towards and away from each other. The holder 40 is formed with a hole 43 extending through the holder 40 in a direction in parallel with the above-mentioned direction P to thereby define the flexible portions 42*a* and 42*b*.

The holder 40 is formed with a recess 44 to avoid interfering with the core wire 52 fixed in the compression section 13 of each of the terminals 10 inserted into the housing 20.

Figure 7:
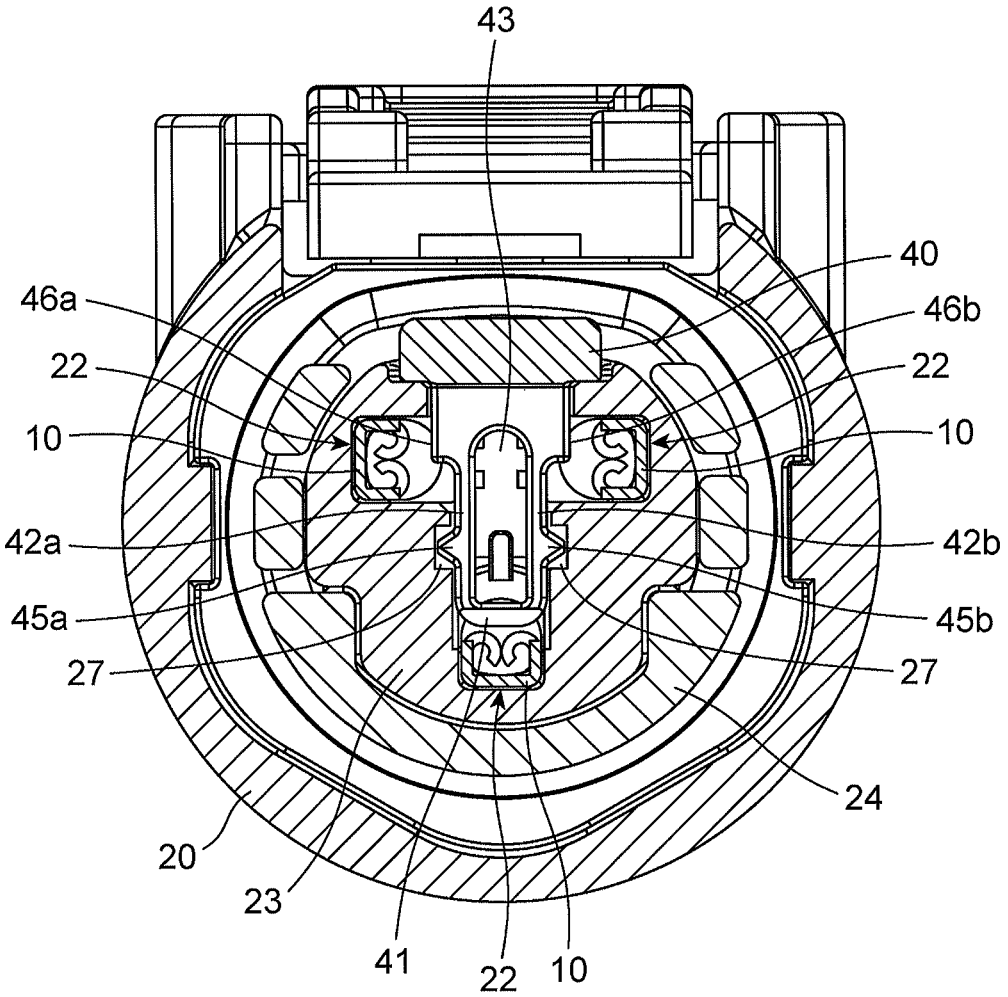
FIG. 7 is a cross-sectional view taken along the line B-B in FIG. 5.
Figure 8:
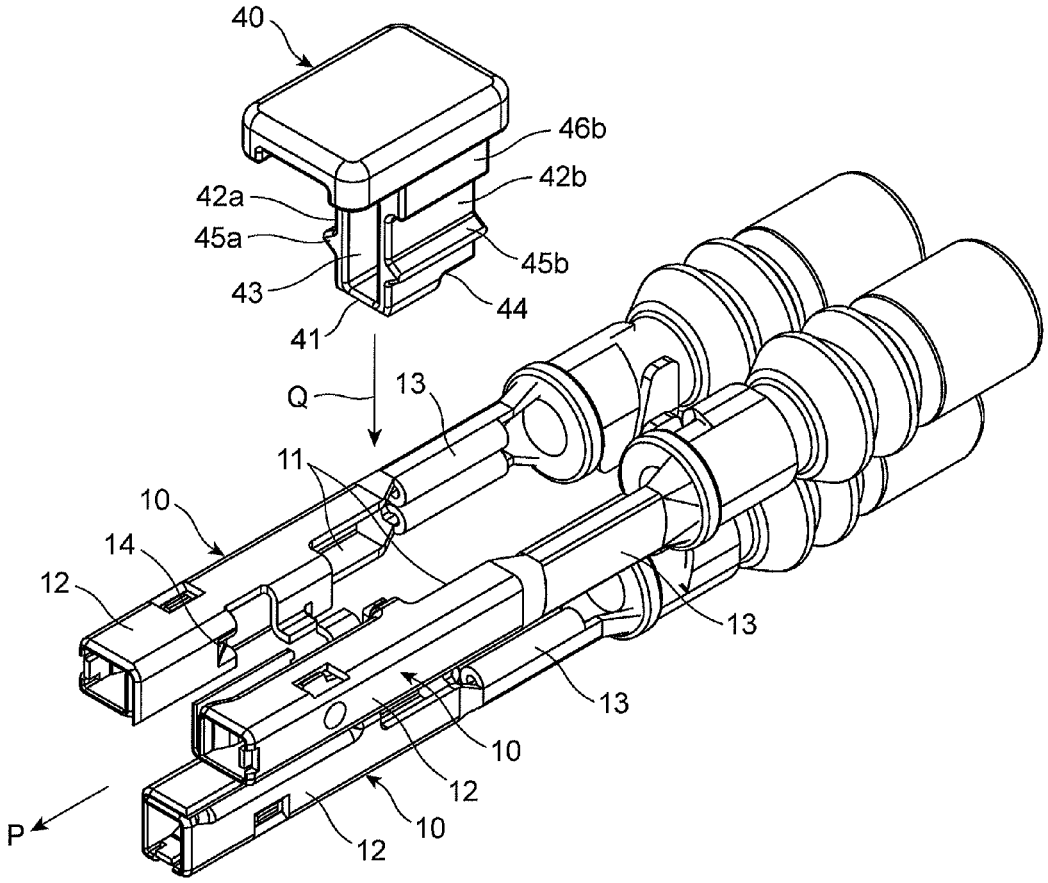
FIG. 8 is a broken perspective view of the terminals and the holder both of which comprise the electric connector illustrated in FIG. 1.
Figure 9:
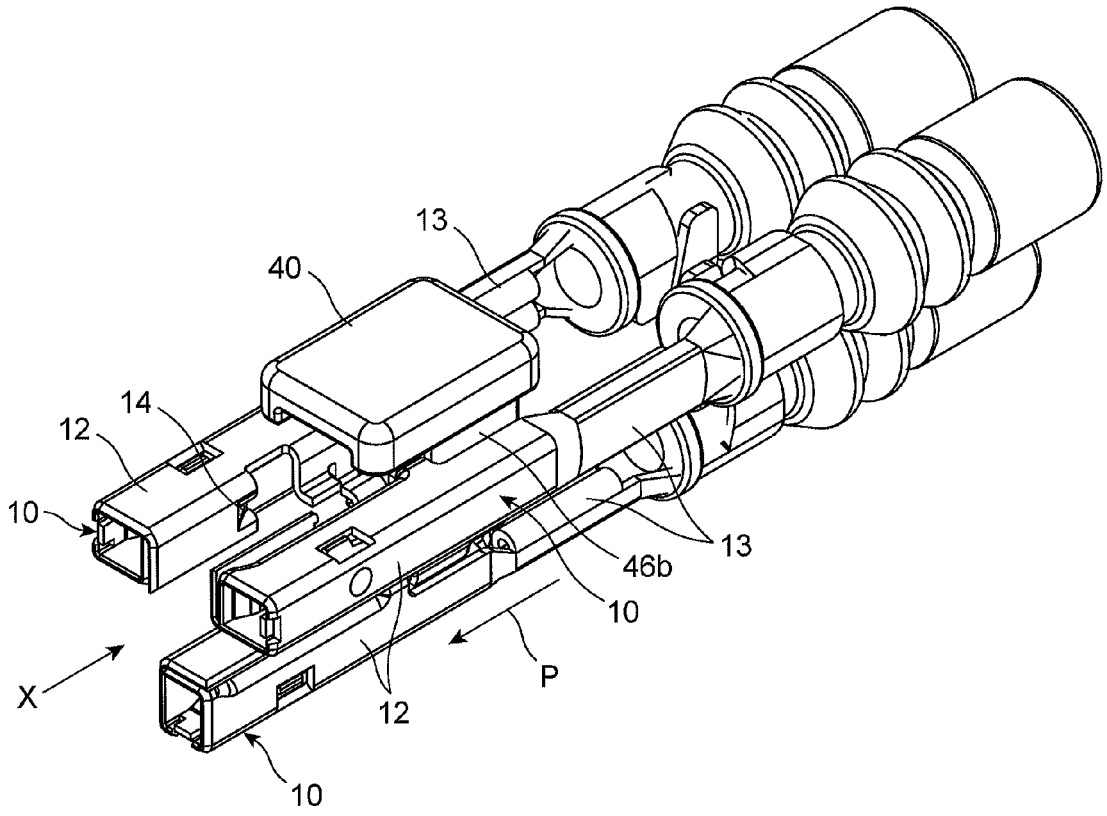
FIG. 9 is a perspective view of the terminals and the holder illustrated in FIG. 8, both being engaged to each other.

Furthermore, as illustrated in FIG. 7, the holder 40 is formed at the flexible portions 42*a* and 42*b* with engagement protrusions 45*a* and 45*b*, respectively, fittable into recesses 27 formed at the terminal house 23 in the housing 20.

The holder 40 in the first embodiment is composed of resilient and electrically insulative synthetic resin, but may be designed to be composed of any other material.

Figure 10:
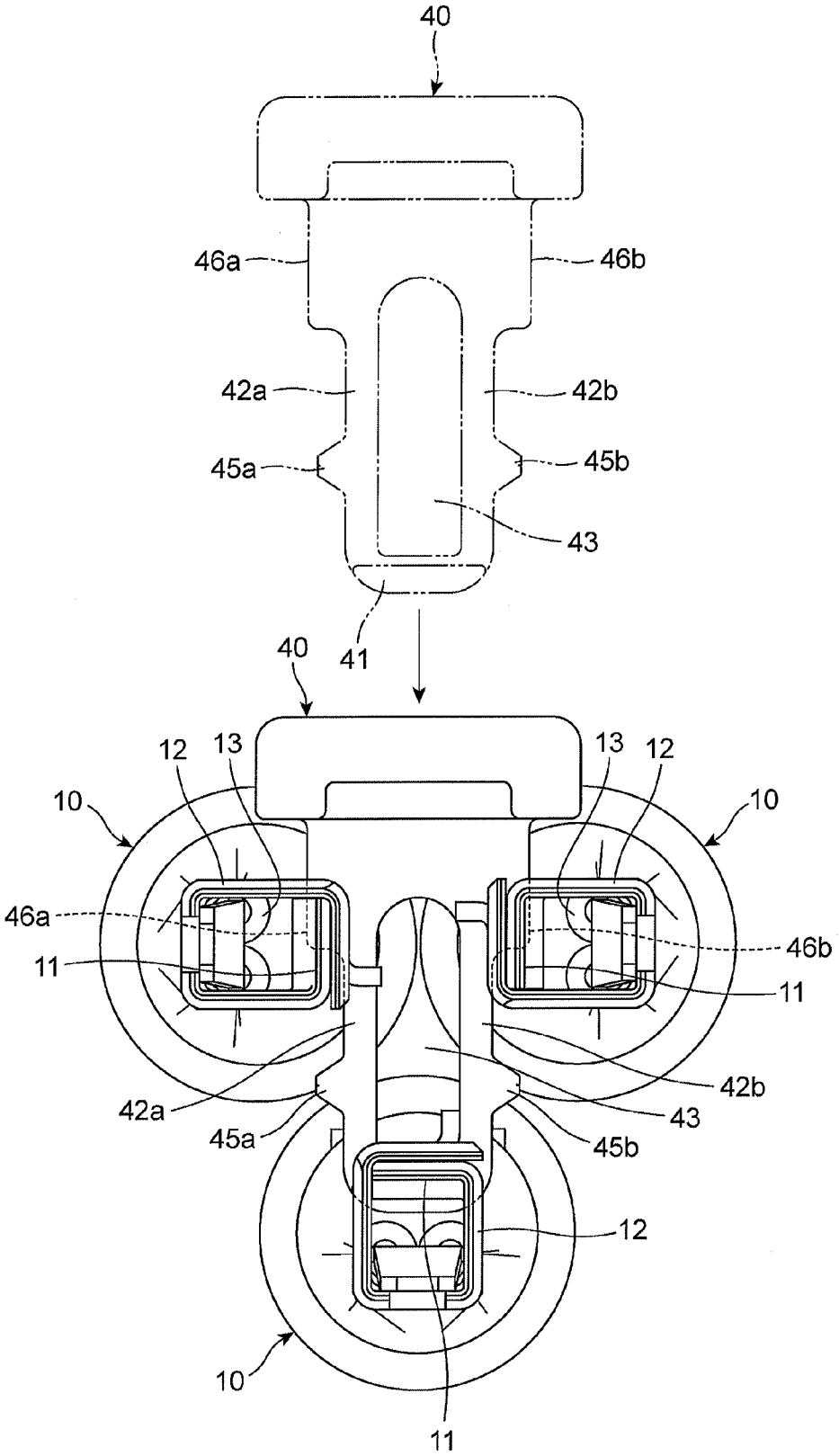
FIG. 10 is a front view viewed in a direction indicated with an arrow X shown in FIG. 9.

As mentioned above, the electric connector 100 includes the three terminals 10. As illustrated in FIG. 10, any two terminals 10 among the three terminals 10 are housed in the housing 20 such that the stepped portions 11 thereof are fit into the sidewalls 46*a* and 46*b* of the holder 40, and the remainder terminal 10 is housed in the housing 20 such that the stepped portion 11 thereof is fit into the front 41 of the holder 40. Specifically, the two terminals 10 among the three terminals 10 are situated in the housing 20 such that the stepped portions 11 thereof face each other, and the remainder terminal 10 is situated in the housing 20 such that the stepped portion 11 thereof is directed in a direction perpendicular to a direction in which the stepped portions 11 of the two terminals 10 are directed.

Thus, it is possible to gather a plurality of the terminals 10 in an area in which the stepped portions 11 of the terminals 10 are engaged to the front 41 and the sidewalls 46*a* and 46*b* of the holder 40, ensuring that an area for arranging the terminals 10 therein can be avoided from being large, and thus, the electric connector 100 can be down-sized and can save a space for itself. In addition, since what is required to the holder 40 is to include the front 41 and the sidewalls 46*a* and 46*b* each having a shape fittable to each of the stepped portions 11, the holder 40 can be designed to be simplified in a shape, and can be readily inserted into the housing 20 through the opening 21, ensuring that the electric connector 100 can be readily assembled.

Figure 11:
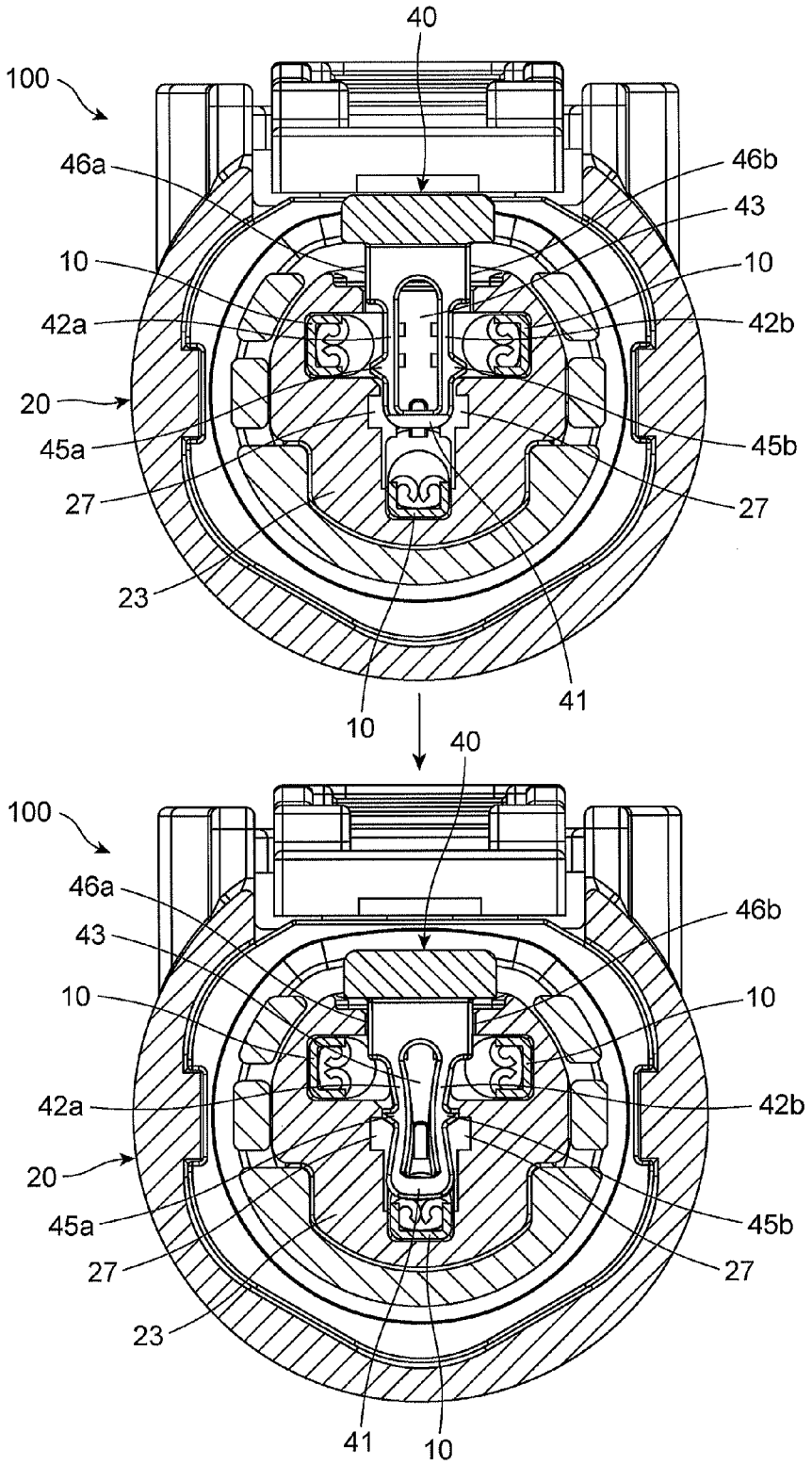
FIG. 11 is cross-sectional views illustrating steps of the holder being inserted into the housing.

As illustrated in FIG. 10, since the holder 40 includes the flexible portions 42*a* and 42*b* extending from the sidewalls 46*a* and 46*b* and resiliently deformable to move towards and away from each other, the holder 40 is able to absorb a compressive force exerted thereon by the terminal house 23 of the housing 20 and/or the terminals 10 through the resilient deformation of the flexible portions 42*a* and 42*b* while the holder 40 is inserted into the housing 20 through the opening 21 of the housing 20, as illustrated in FIGS. 2 and 11. Thus, the holder 40 can be inserted into the housing 20 with a less force, ensuring that the electric connector 100 can be assembled with reduced work volume.

Furthermore, as illustrated in FIG. 7, since the flexible portions 42*a* and 42*b* of the holder 40 having been inserted into the housing 20 compress the housing 20 and the stepped portions 11 of the terminals 10 by virtue of the resilient reaction force thereof, the terminals 10 are kept stably engaged in the housing 20.

The holder 40 is designed to have the flexible portions 42*a* and 42*b* by forming the hole 43 extending therethrough in the direction P in which the terminals 10 are inserted into the housing 20. Hence, the flexible portions 42*a* and 42*b* can be stably resiliently deformed without avoiding the holder 40 from being complicated in shape. Furthermore, it is possible to reduce a volume of a material of which the holder 40 is composed, and further to reduce a weight of the volume 40 by forming the hole 43 extending through the holder 40.

The holder 40 is designed to have the recess 44 in order to avoid from interfering with the core wire 52 fixed in the wire compression section 13 of the terminal 10 inserted into the housing 20. Thus, there is formed a clearance between the holder 40 inserted into the housing 20 and the core wire 52 fixed in the wire compression section 13, it is possible to avoid the core wire 52 from being damaged due to interference between the core wire 52 and the holder 40.

If the holder 40 were inserted into the housing 20 through the opening 21 without the terminals 10 being inserted at accurate position into the holes 22 (see FIG. 6) in the housing 20, the front 41 of the holder 40 would not align in position with the stepped portion 11 of the terminal 10, resulting in that the holder 40 cannot be inserted into a desired position in the opening 21 of the housing 20. Accordingly, it is possible to detect a defect in the connection between the terminals 10 and the housing 20.

The flexible portions 42*a* and 42*b* of the holder 40 are designed to include the engagement protrusions 45*a* and 45*b* fittable into the recesses 27 formed within the opening 21 of the housing 20. Thus, as illustrated in FIG. 7, the engagement protrusions 45*a* and 45*b* are fit into the recesses 27 in the housing 20 when the holder 40 is inserted into the housing 20, and hence, the holder 40 is kept engaged in the housing 20, ensuring it possible to prevent the holder 40 from being released from the housing 20.

Second Embodiment

An electric connector 200 in accordance with the second embodiment of the present invention is explained hereinbelow with reference to FIGS. 12 to 15.

Parts or elements that correspond to those of the electric connector 100 have been provided with the same reference numerals, and operate in the same manner as corresponding parts or elements in the first embodiment, unless explicitly explained hereinbelow.

The electric connector 200 includes a housing 30, and five terminals 10 to be inserted into the housing 30.

Figure 12:
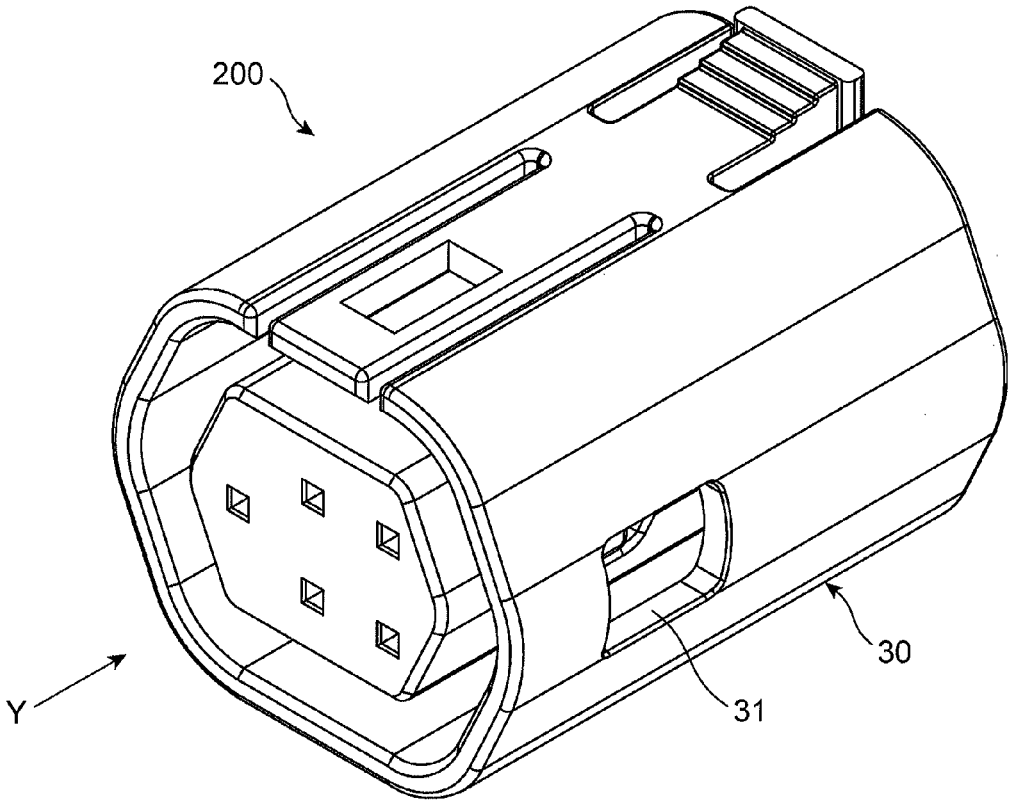
FIG. 12 is a perspective view of the electric connector in accordance with the second embodiment of the present invention.
Figure 13:
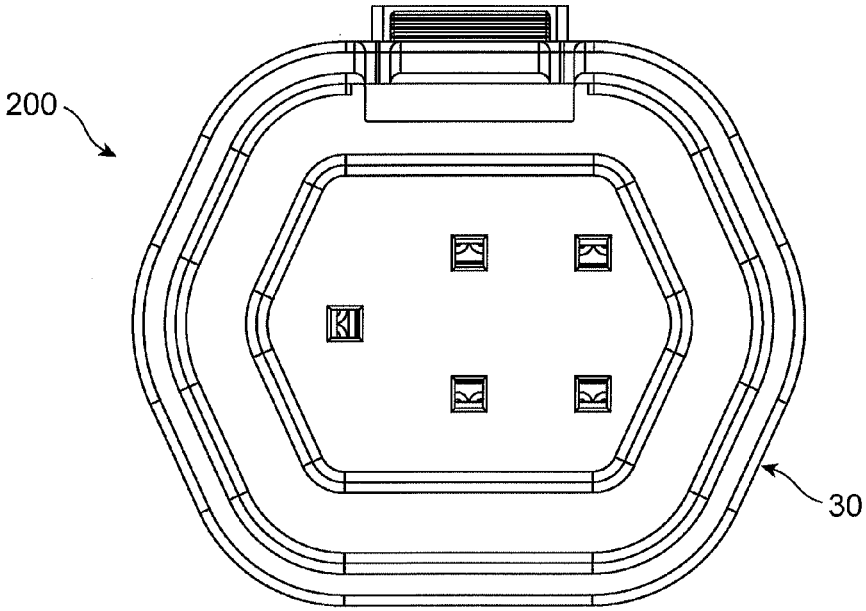
FIG. 13 is a front view of the electric connector illustrated in FIG. 12, viewed in a direction indicated with an arrow Y shown in FIG. 12.
Figure 14:
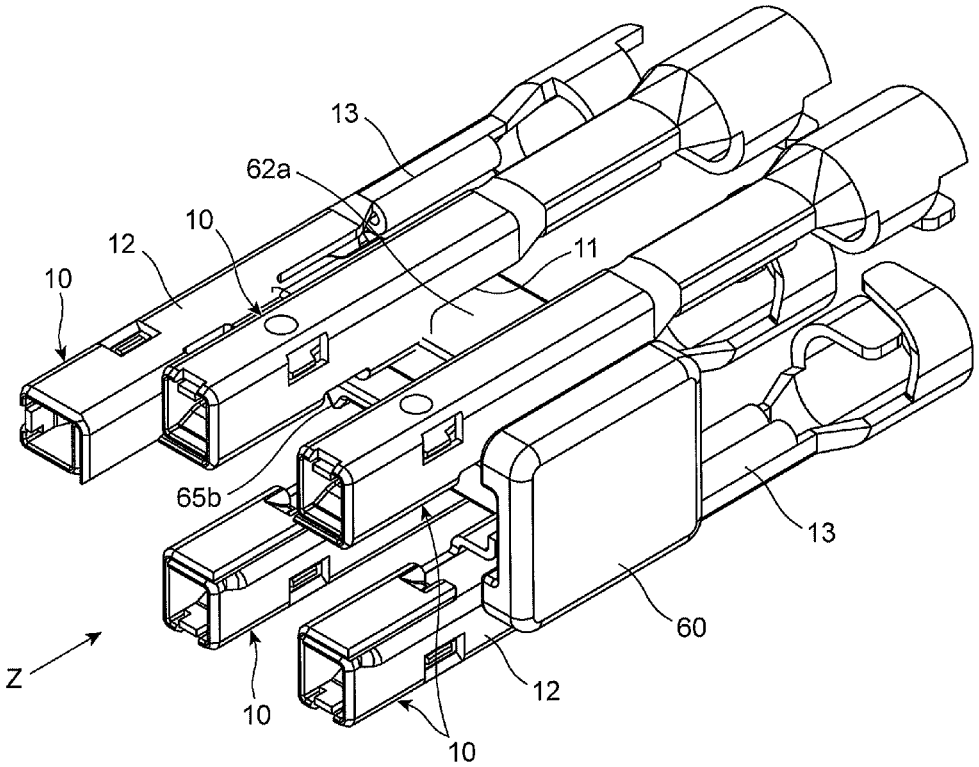
FIG. 14 is a perspective view of the terminals and the holder being engaged to each other, both comprising the electric connector illustrated in FIG. 12.
Figure 15:
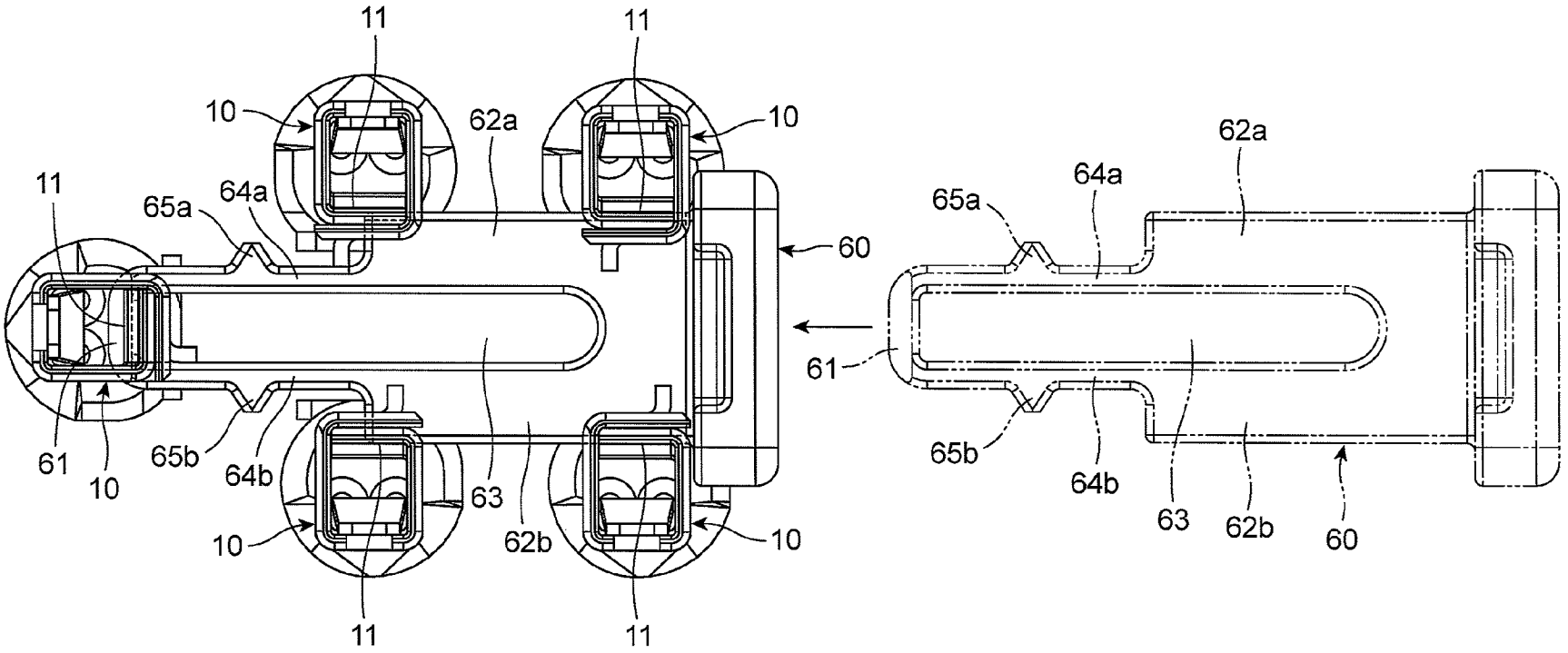
FIG. 15 is a front view viewed in a direction indicated with an arrow Z shown in FIG. 14.

As illustrated in FIG. 12, four terminals 10 are situated in two rows such that stepped portions 11 thereof face each other, and the remainder terminal 10 is situated away from the two rows and on a center line between the two rows such that the stepped portion 11 thereof is directed in a direction perpendicular to a direction in which the stepped portions 11 of the four terminals 10 are directed.

A holder 60 corresponding to the holder 40 in the first embodiment is inserted into the housing 30 through an opening 31 formed at a circumferential wall of the housing 30 for keeping the terminals 10 engaged in the housing 30. The holder 60 includes a front 61 and a pair of sidewalls 62*a* and 62*b* fittable into the stepped portions 11 of the five terminals 10. The holder 60 is formed therethrough with a hole 63 (see FIG. 15) to thereby define a pair of flexible portions 64*a* and 64*b* extending from the sidewalls 62*a* and 62*b*. Engagement protrusions 65*a* and 65*b* outwardly protruding from the flexible portions 64*a* and 64*b* have the same functions as those of the engagement protrusions 45*a* and 45*b* illustrated in FIG. 7.

In the electric connector 200, since a plurality of the terminals 10 are gathered in an area in which the stepped portions 11 of the terminals 10 are engaged to the front 61 and the sidewalls 62*a* and 62*b* of the holder 60, it is possible to avoid an area for arranging the terminals 10 therein from being large, ensuring that the electric connector 200 can be downsized and can save a space for itself. In addition, since what is required to the holder 60 is to include the front 61 and the sidewalls 62*a* and 62*b* each having a shape fittable to each of the stepped portions 11, the holder 60 can be designed to be simplified in a shape, and can be readily inserted into the housing 30 through the opening 31, ensuring that the electric connector 200 can be readily assembled.

Third Embodiment

An electric connector 300 in accordance with the third embodiment of the present invention is explained hereinbelow with reference to FIGS. 16 to 19.

Parts or elements that correspond to those of the electric connector 100 have been provided with the same reference numerals, and operate in the same manner as corresponding parts or elements in the first embodiment, unless explicitly explained hereinbelow.

The electric connector 300 includes a housing 70, and three terminals 10 to be inserted into the housing 70.

Figure 16:
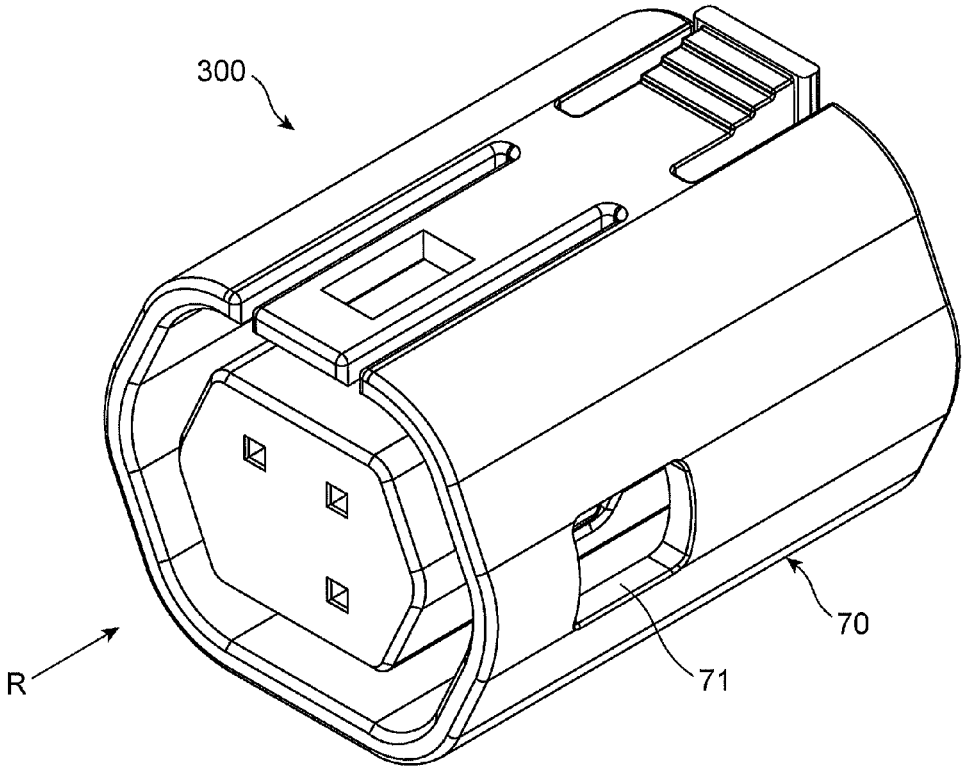
FIG. 16 is a perspective view of the electric connector in accordance with the third embodiment of the present invention.
Figure 17:
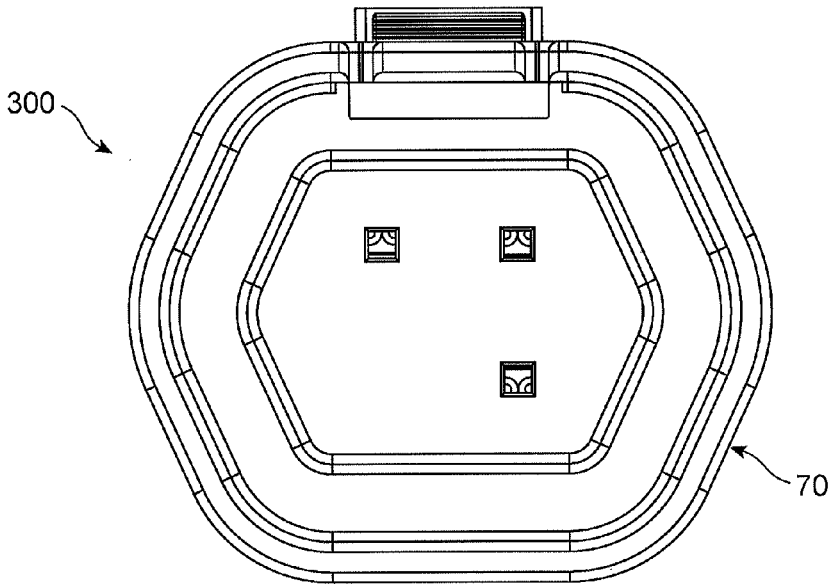
FIG. 17 is a front view viewed in a direction indicated with an arrow R shown in FIG. 16.
Figure 18:
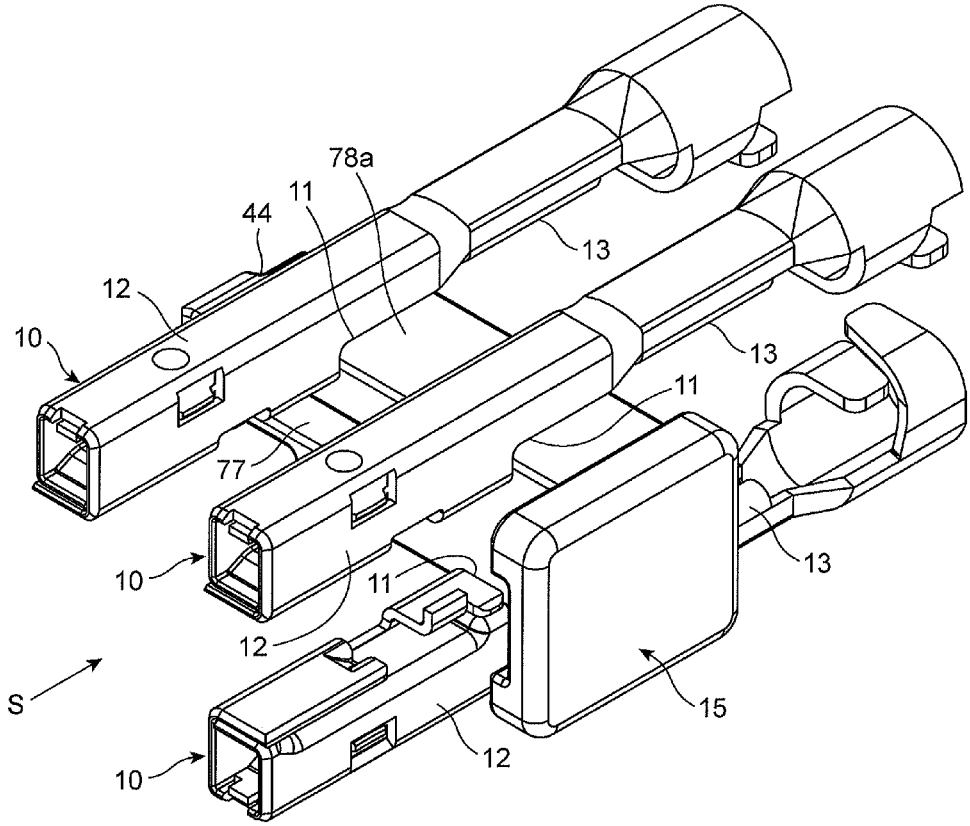
FIG. 18 is a perspective view of the terminals and the holder being engaged to each other, both comprising the electric connector illustrated in FIG. 16.
Figure 19:
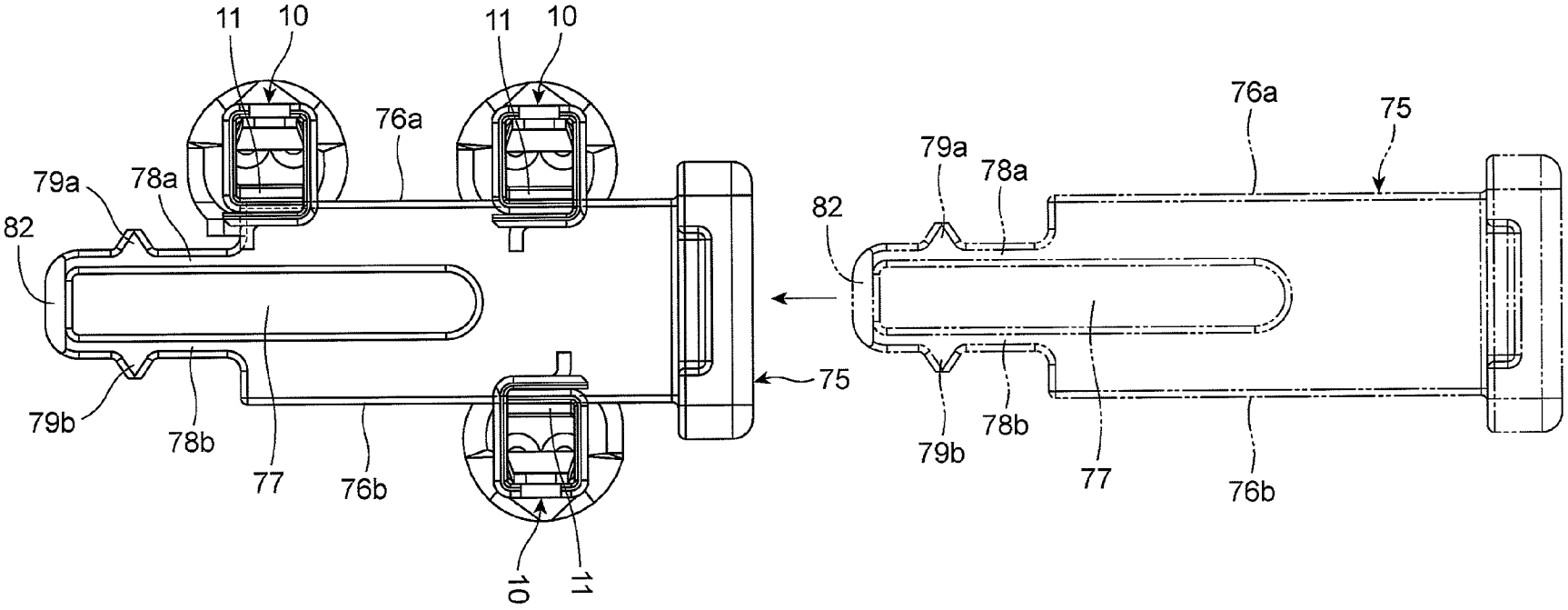
FIG. 19 is a front view viewed in a direction indicated with an arrow S shown in FIG. 18.
Figure 20:
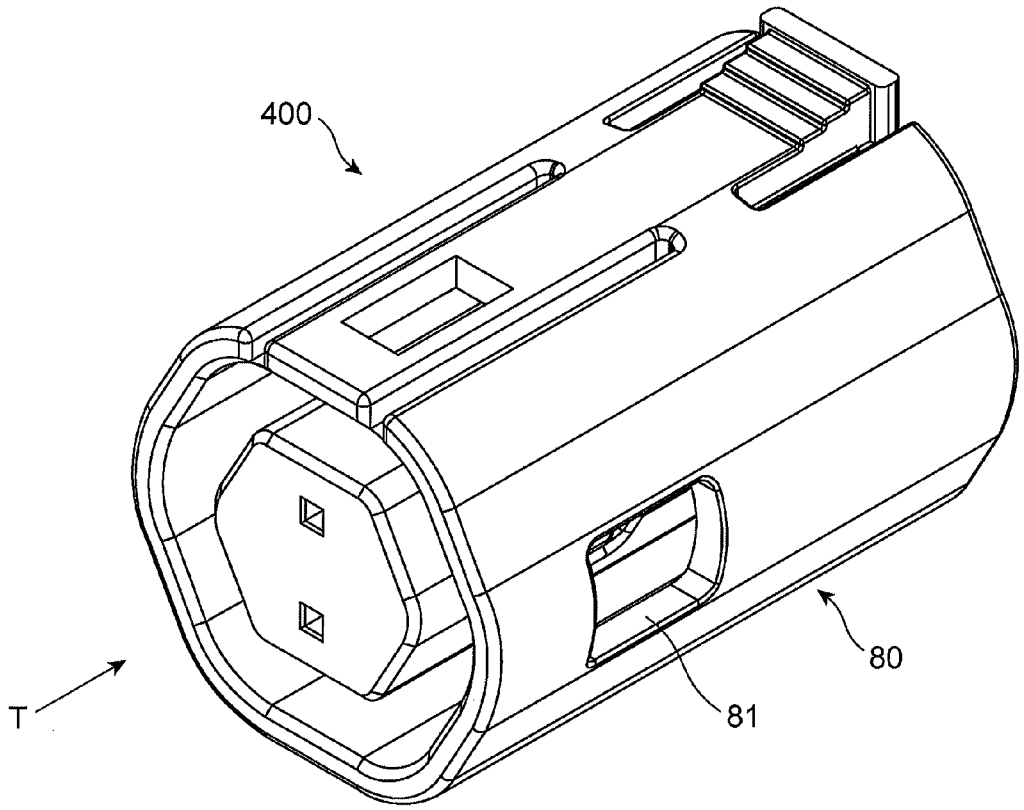
FIG. 20 is a perspective view of the electric connector in accordance with the fourth embodiment of the present invention.
Figure 21:
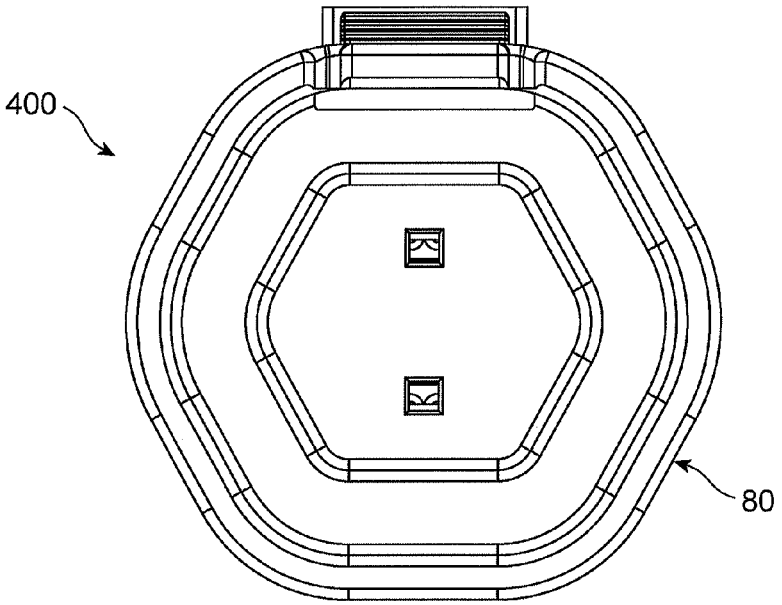
FIG. 21 is a front view viewed in a direction indicated with an arrow T shown in FIG. 20.
Figure 22:
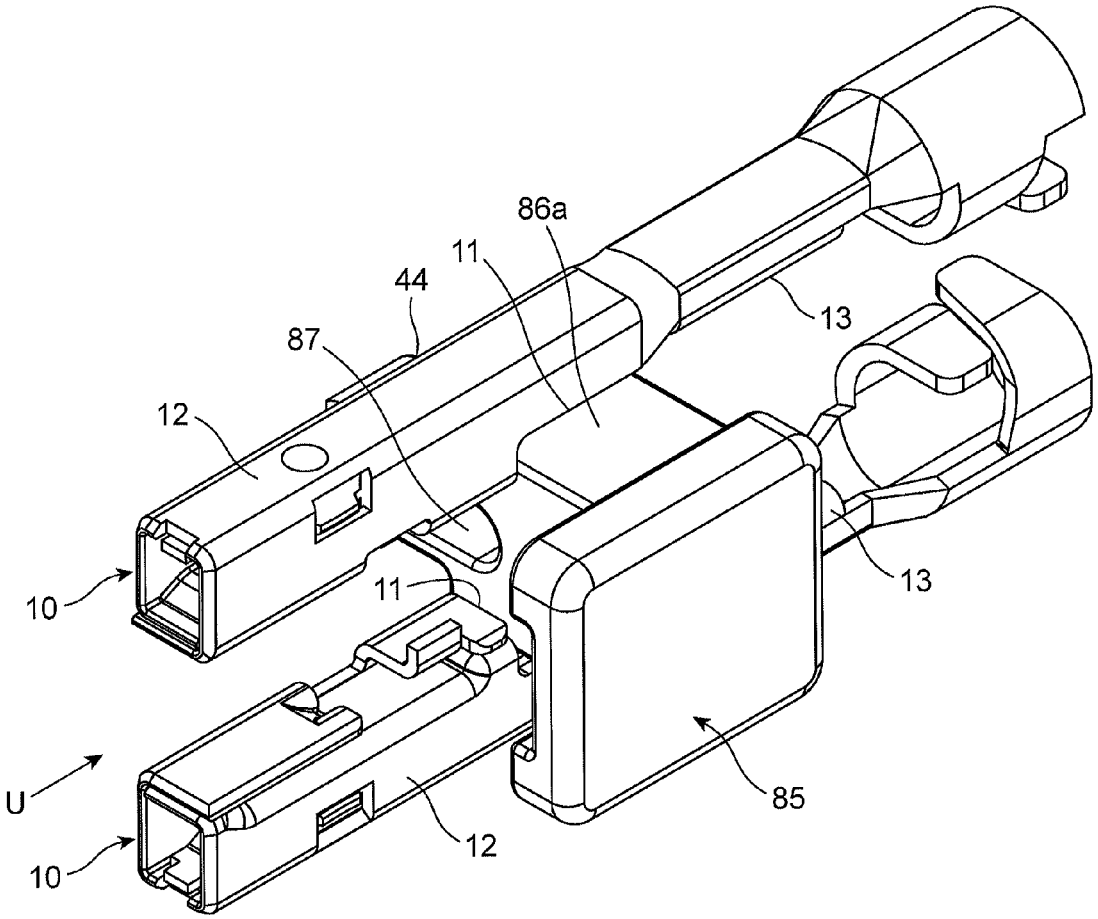
FIG. 22 is a perspective view of the terminals and the holder being engaged to each other, both comprising the electric connector illustrated in FIG. 20.

As illustrated in FIG. 16, two terminals 10 among the three terminals 10 are situated such that stepped portions 11 thereof face each other, and the remainder terminal 10 is situated adjacent to one of the two terminals 10 such that the stepped portion 11 thereof is directed in a direction in which the stepped portions 11 of the two terminals 10 are directed.

A holder 75 corresponding to the holder 40 in the first embodiment is inserted into the housing 70 through an opening 71 formed at a circumferential wall of the housing 70 for keeping the terminals 10 engaged in the housing 70. The holder 75 includes a pair of sidewalls 76*a* and 76*b* fittable into the stepped portions 11 of the three terminals 10. The holder 75 is formed therethrough with a hole 77 (see FIG. 19) to thereby define a pair of flexible portions 78*a* and 78*b* extending from the sidewalls 76*a* and 76*b*. Engagement protrusions 79*a* and 79*b* outwardly protrude from the flexible portions 78*a* and 78*b*. The flexible portions 78*a* and 78*b* are connected at distal ends thereof to each other through a front 82. The engagement protrusions 79*a* and 79*b* have the same functions as those of the engagement protrusions 45*a* and 45*b* illustrated in FIG. 7.

Though the holder 75 used in the electric connector 300 in accordance with the third embodiment is designed to include the front 82 fittable to the stepped portion 11 of the terminal 10, the front 82 is not engaged to the terminal 10 in the third embodiment.

Fourth Embodiment

An electric connector 400 in accordance with the fourth embodiment of the present invention is explained hereinbelow with reference to FIGS. 20 to 23.

Parts or elements that correspond to those of the electric connector 100 have been provided with the same reference numerals, and operate in the same manner as corresponding parts or elements in the first embodiment, unless explicitly explained hereinbelow.

The electric connector 400 includes a housing 80, and two terminals 10 to be inserted into the housing 80.

Figure 23:
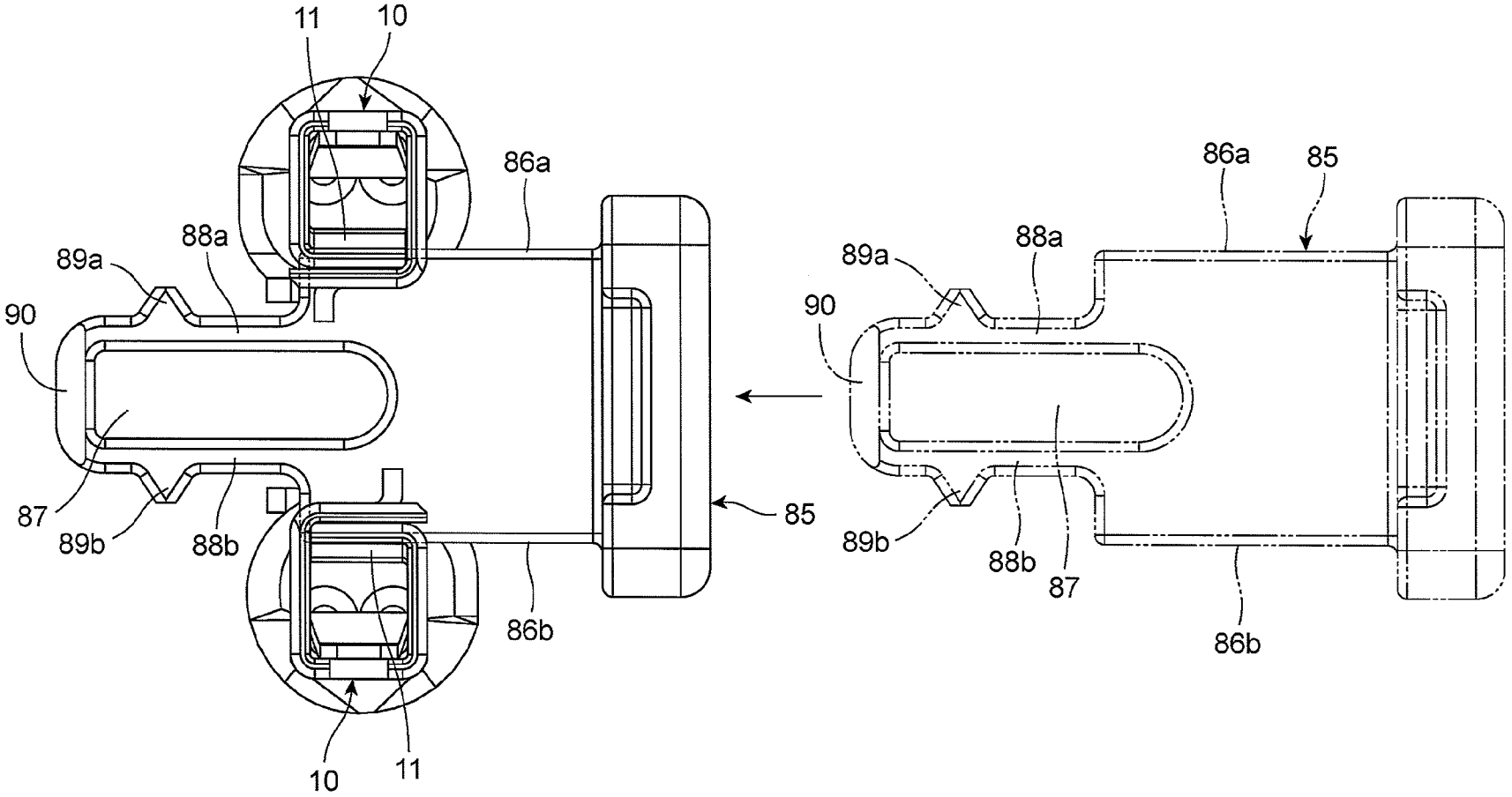
FIG. 23 is a front view viewed in a direction indicated with an arrow U shown in FIG. 22.
Figure 24:
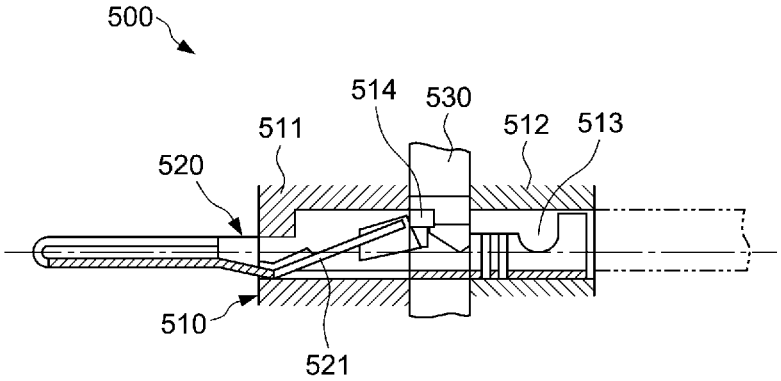
FIG. 24 Prior Art
FIG. 24 is a cross-sectional view of the conventional plug.
Figure 25:
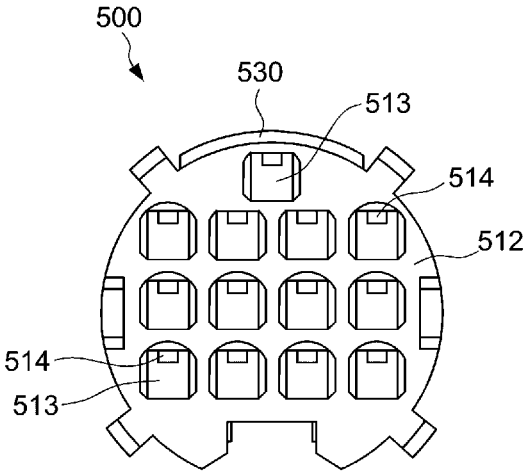
FIG. 25 Prior Art
FIG. 25 is a rear view of the conventional plug illustrated in FIG. 24.
Figure 26:
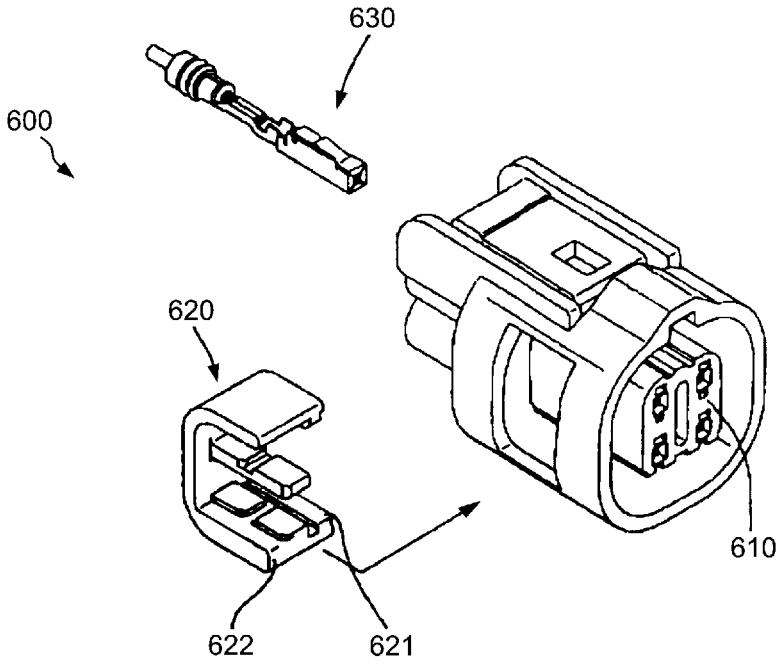
FIG. 26 Prior Art
FIG. 26 is a perspective view of the conventional connector.
Figure 27:
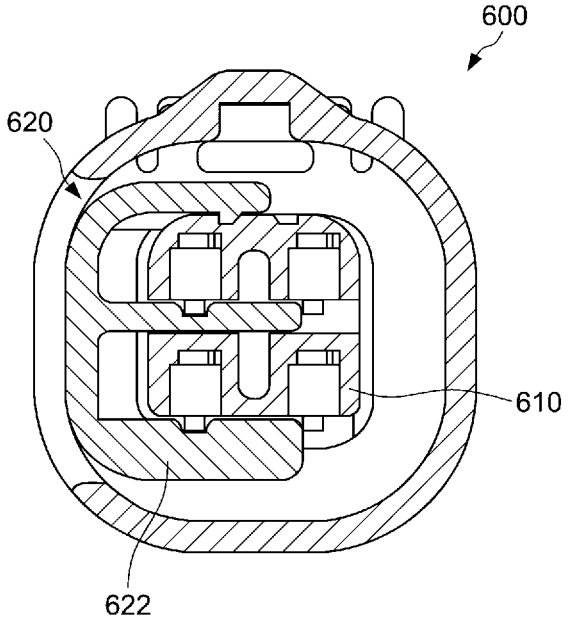
FIG. 27 Prior Art
FIG. 27 is longitudinal cross-sectional view of the conventional connector illustrated in FIG. 26.
Figure 28:
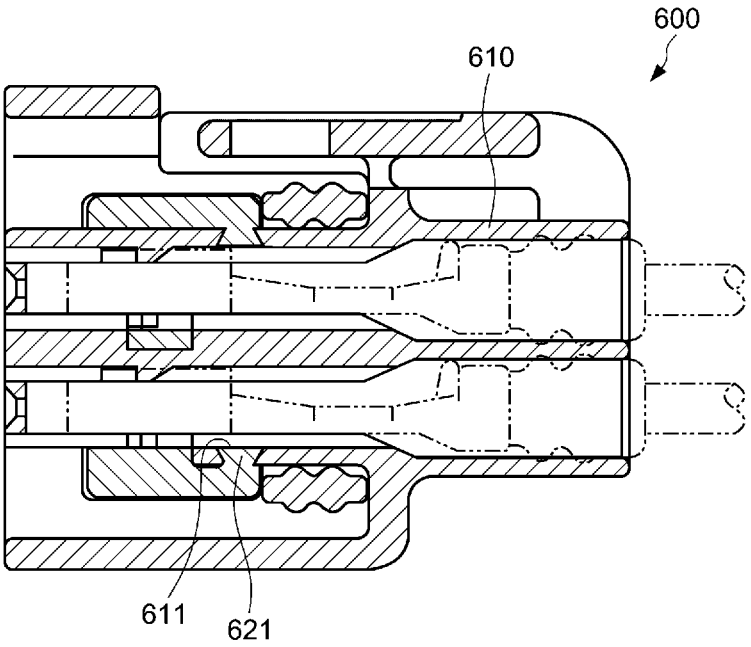
FIG. 28 Prior Art
FIG. 28 is a lateral cross-sectional view of the conventional connector illustrated in FIG. 26.

As illustrated in FIG. 23, the terminals 10 are situated such that the stepped portions 11 thereof face each other.

A holder 85 corresponding to the holder 40 in the first embodiment is inserted into the housing 80 through an opening 81 formed at a circumferential wall of the housing 80 for keeping the terminals 10 engaged in the housing 80. The holder 85 includes a pair of sidewalls 86*a* and 86*b* fittable into the stepped portions 11 of the two terminals 10. The holder 85 is formed therethrough with a hole 87 (see FIG. 23) to thereby define a pair of flexible portions 88*a* and 88*b* extending from the sidewalls 86*a* and 86*b*. Engagement protrusions 89*a* and 89*b* outwardly protrude from the flexible portions 88*a* and 88*b*. The flexible portions 88*a* and 88*b* are connected at distal ends thereof to each other through a front 90. The engagement protrusions 89*a* and 89*b* have the same functions as those of the engagement protrusions 45*a* and 45*b* illustrated in FIG. 7.

Though the holder 85 used in the electric connector 700 in accordance with the fourth embodiment is designed to include the front 90 fittable to the stepped portion 11 of the terminal 10, the front 90 is not engaged to the terminal 10 in the fourth embodiment.

Each of the electric connectors 100 to 400 in accordance with the above-mentioned first to fourth embodiments comprises a female electric connector being fit into a male electric connector equipped in an engine room of an automobile to thereby electrically connect to the male electric connector, for instance. However, it should be noted that the electric connectors 100 to 400 are just examples of the present invention, and the scope of the present invention is not to be limited to those embodiments.

INDUSTRIAL APPLICABILITY

The electric connector in accordance with the present invention is able to be used broadly in various fields such as an automobile industry and electric/electronic device industries, as a wire connector for transmitting electric signals therethrough.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2013-117054 filed on Jun. 3, 2013 including specification, claims, drawings and summary is incorporated herein by reference in its entirety.

What is claimed is:

1. An electric connector comprising:

a housing formed with an opening;

a plurality of terminals each having a stepped portion recessed or raised in a direction intersecting a direction in which said terminals are inserted into a said housing, said terminals being inserted into said housing; and a holder inserted into said housing through said opening and engaged to said stepped portions of said terminals to thereby fix said terminals in said housing, said holder including:

a front and a pair of sidewalls all of which are shaped to be engageable to said stepped portions of said terminals when said holder is inserted into said housing; and a pair of flexible portions resiliently deformable to move towards and away from each other.

2. The electric connector as set forth in claim 1, wherein said flexible portions and said sidewalls are formed integral with each other within a common plane.

3. The electric connector as set forth in claim 1, wherein said terminals include M terminals (M is an odd integer equal to or greater than 3), (M−1) terminals are situated in two rows such that said stepped portions thereof face each other, and the remainder terminal is situated on a center line between said two rows and away from said two rows such that a stepped portion thereof is directed in a direction perpendicular to a direction in which said stepped portions of said (M−1) terminals are directed, or the remainder terminal is situated on an extension of one of said two rows such that said stepped portion thereof is directed in a direction in which said stepped portions of said (M−1) terminals are directed.

4. The electric connector as set forth in claim 1, wherein said terminals include an even number of terminals, and said terminals being situated in two rows such that said stepped portions thereof face each other.

5. The electric connector as set forth in claim 1, wherein said holder is formed with a hole extending in a direction in parallel with said direction in which said terminals are inserted into said housing, and sidewalls of said holder defining said hole define said flexible portions.

6. The electric connector as set forth in claim 1, wherein said holder is formed with a recess to avoid interfering with a core wire fixed to each of said terminals.

7. The electric connector as set forth in claim 1, wherein each of said flexible portions includes a protrusion fittable into a recess formed in said housing.

8. The electric connector as set forth in claim 1, wherein said holder is composed of resilient and electrically insulative synthetic resin.

9. An electric connector into which a plurality of terminals each having a stepped portion recessed or raised in a direction is inserted, said electric connector comprising:

a housing formed with an opening, said direction intersecting a direction in which said terminals are inserted into said housing; and a holder inserted into said housing through said opening and engaged to said stepped portions of said terminals to thereby fix said terminals in said housing, said holder including:

a front and a pair of sidewalls all of which are shaped to be engageable to said stepped portions of said terminals when said holder is inserted into said housing; and a pair of flexible portions resiliently deformable to move towards and away from each other.

10. The electric connector as set forth in claim 9, wherein said flexible portions and said sidewalls are formed integral with each other within a common plane.

11. The electric connector as set forth in claim 9, wherein said holder is formed with a hole extending in a direction in parallel with said direction in which said terminals are inserted into said housing, and sidewalls of said holder defining said hole define said flexible portions.

12. The electric connector as set forth in claim 9, wherein said holder is formed with a recess to avoid interfering with a core wire fixed to each of said terminals.

13. The electric connector as set forth in claim 9, wherein each of said flexible portions includes a protrusion fittable into a recess formed in said housing.

14. The electric connector as set forth in claim 9, wherein said holder is composed of resilient and electrically insulative synthetic resin.

15. A holder to be used in an electric connector into which a plurality of terminals each having a stepped portion recessed or raised in a direction is inserted, said electric connector including a housing formed with an opening, said direction intersecting a direction in which said terminals are inserted into said housing, said holder being inserted into said housing through said opening and engaged to said stepped portions of said terminals to thereby fix said terminals in said housing, said holder including:

a front and a pair of sidewalls all of which are shaped to be engageable to said stepped portions of said terminals when said holder is inserted into said housing; and a pair of flexible portions resiliently deformable to move towards and away from each other.

16. The holder as set forth in claim 15, wherein said flexible portions and said sidewalls are formed integral with each other within a common plane.

17. The holder as set forth in claim 15, wherein said holder is formed with a hole extending in a direction in parallel with said direction in which said terminals are inserted into said housing, and sidewalls of said holder defining said hole define said flexible portions.

18. The holder as set forth in claim 15, wherein said holder is formed with a recess to avoid interfering with a core wire fixed to each of said terminals.

19. The holder as set forth in claim 15, wherein each of said flexible portions includes a protrusion fittable into a recess formed in said housing.

20. The holder as set forth in claim 15, wherein said holder is composed of resilient and electrically insulative synthetic resin.

* * * * *